US006041463A

United States Patent [19]

Stauch

[11] Patent Number: 6,041,463

[45] Date of Patent: Mar. 28, 2000

[54] HAND HELD SWEEPER

[75] Inventor: Dennis J. Stauch, Wilsonville, Oreg.

[73] Assignee: Shindaiwa, Inc., Tualatin, Oreg.

[21] Appl. No.: 08/883,758

[22] Filed: Jun. 26, 1997

[51] Int. Cl.[7] ..... A46B 13/02; A46B 3/16

[52] U.S. Cl. ..... 15/52.1; 15/50.3; 15/182; 15/23

[58] Field of Search ..... 15/23, 28, 49.1, 15/50.3, 52.1, 179, 182

[56] References Cited

U.S. PATENT DOCUMENTS

| | | | |
|---|---|---|---|
| 1,474,994 | 11/1923 | Brown . | |
| 1,721,655 | 7/1929 | Carlson . | |
| 1,951,851 | 3/1934 | Turner . | |
| 1,959,307 | 5/1934 | Sanger . | |
| 2,014,626 | 9/1935 | Moorehead | 15/52.1 |
| 2,132,465 | 10/1938 | Gast . | |
| 2,190,576 | 2/1940 | Sisman | 15/50.3 |
| 2,660,746 | 12/1953 | Ward . | |
| 3,172,138 | 3/1965 | Price . | |
| 3,464,077 | 9/1969 | Hunt | 15/182 |
| 3,793,782 | 2/1974 | Bowling | 15/23 |
| 4,926,516 | 5/1990 | Valvo . | |
| 4,993,192 | 2/1991 | Demetrius . | |
| 5,115,534 | 5/1992 | Fournier . | |

*Primary Examiner*—Terrence R. Till
*Attorney, Agent, or Firm*—Robert L. Harrington

[57] ABSTRACT

A hand held power driven sweeper that is supported on brush assemblies. The brush assemblies are horizontally mounted on the end of a handle component. The brush assemblies are readily mounted and removed from the handle component. A power component on the opposite end of the hand component provides motive power for the brush assemblies. The brush assemblies have bristles selected from a diameter and length range to provide a bristle density that provides a desired sweeping action as well as support for the sweeper. The bristles are of the type that will have a slight break over to produce the sweeping action.

8 Claims, 2 Drawing Sheets

HAND HELD SWEEPER

FIELD OF THE INVENTION

This invention relates to motor powered brush-type sweepers primarily used for industrial and outdoor sweeping and particularly of the type which can be hand held, i.e., as opposed to being wheel mounted.

BACKGROUND OF THE INVENTION

A prior art tool generally of the type here considered is disclosed in U.S. Pat. Nos. 5,269,082 and 5,161,318. This tool is sold on the market under the trademark "POWER BROOM" by the assignee of the present invention. The "POWER BROOM" sweeper is a proven tool for all kinds of sweeping tasks from sweeping snow off of sidewalks to cleaning debris off of roofs, patios and driveways. This tool includes pliable fins mounted on a rotating cylinder. The rotating fins support the weight of the tool and as the fins engage the surface being cleaned, they pass under the cylinder where they bend rearwardly under the weight of the machine and upon exiting from under the cylinder, the fins flip forward to whisk loose materials away from the tool.

There are, however, a number of tasks for which the "POWER BROOM" is not suitable. The fins will not clean out grooves in the surface being cleaned and they do not readily dislodge debris that is adhered to the surface. A bristle-type brush is more suited for these tasks. However, the only cylindrically configured bristle brushes known are brushes mounted on wheels. A wheeled brush is not as maneuverable, the wheels add undesired weight and increased manufacturing costs. Also, it is not as easily stored or transported. It is accordingly an objective of this invention to provide a "POWER BROOM"-type sweeper, i.e., a hand held sweeper, that utilizes bristles.

BRIEF DESCRIPTION OF THE INVENTION

Unlike a string trimmer or brush cutter, the weight of a sweeping tool is too great to enable a worker or operator to simply carry the tool. The weight of the wheelless sweeping tool has to be carried by the rotating brush and in that respect, the sweeping tool is unlike the other hand held tools mentioned. The rotating brush in contact with a surface to be cleaned introduces considerable complexity. If the brush bristles are so stiff as to avoid any bending under the weight of the tool during operation, the sweeping action is accomplished only by the tips of the bristles in contact with the surface and such a sweeping action is unsatisfactory. The bristles must bend and partially lay against the surface to achieve a desired sweeping action. On the other hand, if the bristles are too pliable, they will collapse and drag on the surface and the resulting sweeping action will also be unsatisfactory. If the weight of the tool is great, e.g., greater than 25–30 pounds, and assuming the power source is sufficient to rotate the brush, the brush will pull in the direction of rotation to such an extent that it is unacceptable for manual operation. The brush must be sufficiently wide for efficiency and as the brush is widened, the support has to be stronger and heavier so as to further complicate the brush design.

All of these factors were encountered in the development of the present tool. It was first learned that pliability versus rigidity of the bristles was not so much a matter of individual bristle strength or rigidity but more of bristle density. That is, the greater the number of bristles contacting the surface, the less weight each individual bristle carries. Also, the more crowded the bristles, the more support the individual bristles receive from surrounding bristles.

Brushes of the type here contemplated as used for sweeping tasks are commonly produced either by strip forming or tuft forming. In the former, long channel-shaped strips are provided with bristles that are crimped inside the channel and the strip is wrapped around a cylindrical core. In tuft forming, holes are provided in a support member and filled with bristles. The support member is formed into a cylindrical shape. As technology presently exists, both types have been found to be inadequate. In order to obtain sufficient bristle density for the strip-type brushes, the strips have to be stacked and contained in a restraining device. This adds complexity of manufacture (and thereby added cost) and increases the overall weight. In tuft forming, the bristles cannot be made sufficiently dense to properly support the tool and produce the desired sweeping action.

Ideally, the weight of the tool is manageable by an operator for lengthy periods of time. A weight of 15 pounds is acceptable, whereas a weight exceeding 30 pounds is not.

It has been determined that the preferred diameter of the core to which the bristles are attached is between one inch and two inches in diameter. A core smaller than one inch is not considered adequately sized and causes too great a fanning of the bristles. A core greater than two inches is considered to add too much weight and produces a brush diameter that is too large.

The ideal bristle length is about four inches. A substantially shorter bristle doesn't produce appropriate bendability and a longer bristle again fans out too far and bends too easily. Also, the large diameter brush, e.g., exceeding 10 inches, produces control difficulties and the smaller diameter brush, e.g., less than about six inches, produces a likelihood of bottoming of the gear mechanism on the surface being cleaned.

A further consideration for the bristles is the water absorption factor. Many applications require sweeping of material that is wet or even the sweeping of water itself, e.g., in the form of snow. A wet bristle bends too easily and accordingly the bristles preferred for the present invention are non-absorbent.

From the above, it is determined that the desirable brush has a one inch to two inch core fitted with four inch long bristles that are non-absorbent, but fitted to a greater density than is typical of sweeping-type brushes. A process that has been found to achieve the desired density involves the placement of bristles in close adjacency in a long row and attached to a long string (either a single or double row of bristles), the string having a thickness of about 0.06 inch and the bristle diameter being between 0.03 and 0.04 inch (0.036 inch being preferred). The string (sometimes hereafter referred to as a thin rope) is then tightly wrapped in spiral fashion around a cylindrical core and bonded to the core. Whereas the bristles fan apart from their adjacent position at the string to a separated position at the periphery, the side-to-side position, i.e., along the axis of the core, remains the same. At the tip ends of the bristles, the bristles are consistently about 0.060 inch apart in all directions, i.e., both axially and circumferentially to produce a dense bristle configuration at the periphery of the brush.

Having optimized the bristles and core arrangement, the remainder of the task is to provide for mounting of the brush to a handle and power source. A preferred handle and power source is illustrated in the patents referred to above. A handle shaft extends from an upper position whereat the handle is gripped by an operator and whereat a power source is mounted (e.g., a gas powered engine), to a lower position whereat two stub shafts protrude laterally (horizontally) relative to the work surface. The two stub shafts are cooperatively rotated by the power shaft via a power line extending along the handle shaft from the power source.

A pair of brushes are to be removably attached to the stub shafts for maintenance and replacement as needed but without adding undesired weight. The present invention provides an adapter for each stub shaft that includes a cylindrical portion that fits an opening through the core of the brush and extends partially into the core to lend strengthening support to the core. The cylindrical portion is secured to the shaft and rotates with the shaft. A shoulder portion on the adapter engages the end of the core of the brush. A bolt extends through the core from the other end and a bolt head also has a shoulder that engages the opposite end of the core. The bolt screws into a threaded opening in the cylindrical portion of the adapter and compresses the core between the two shoulders. The friction fit of the rotating shoulders to the core insures that the bolt will rotate in response to the rotating stub shaft. The bolts are left hand and right hand threaded in relation to the direction of rotation to produce tightening as the brush is rotated.

For each stub shaft there are but three operations for mounting the brushes to the stub shafts. The adapter is mounted to the stub shaft. The brush is mounted to the adapter. A bolt is inserted through the brush core and screwed into the adapter. Removal involves the same three operations applied in reverse order.

With the above construction, the objectives of the invention are met. The brush portion produced from a pair of aluminum cores, e.g., 10 inches long with four inch long, 0.03 inch diameter nylon non-absorbing bristles secured to the core in the manner described and then the brush to the tool handle shaft; and powered by a gas engine mounted to the shaft handle; approaches a weight of about 20 pounds. The tool in a non-operating mode and resting on the bristles provides little or no deflection (bending) of the bristles. When rotating the brush at between 180 to 300 rpms, a desired bending of the bristles produces the digging into cracks and crevices and loosening of adhered material and the flipping action all in accordance with an optimal sweeping action.

The invention will be further appreciated upon reference to the following detailed description and drawings.

DESCRIPTION OF THE PREFERRED EMBODIMENT

Figure 1:
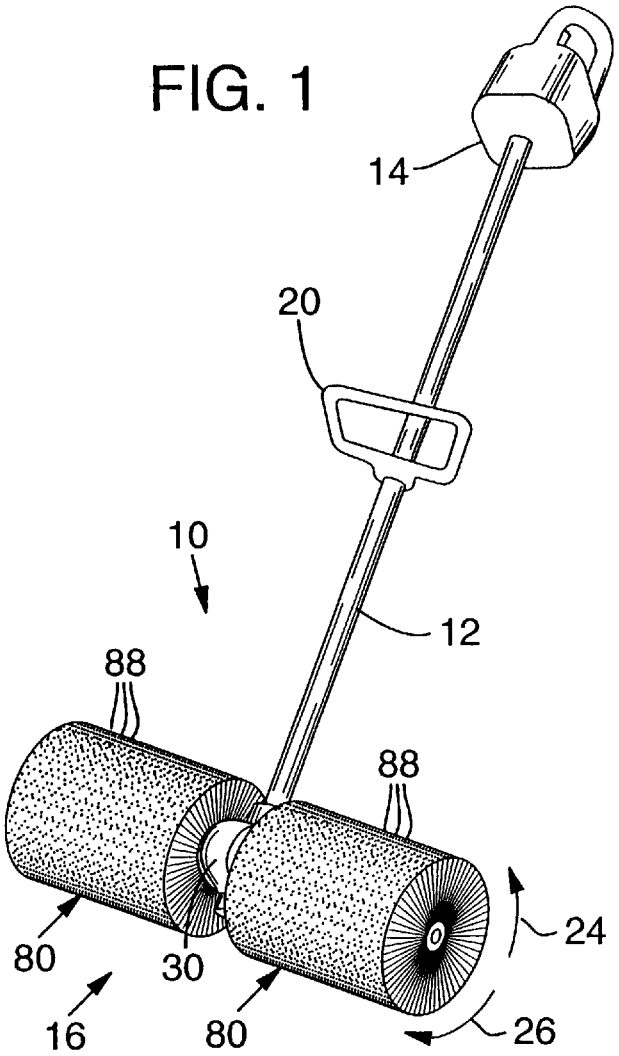
FIG. 1 is a perspective view of a hand held sweeper.

Refer now to FIG. 1 which illustrates a hand held sweeper 10. The sweeper 10 has a handle component or boom 12. A power component 14 such as a drive motor is mounted on one end of the boom 12. A brush component 16 is mounted on the other end of the boom 12 and is arranged to provide a sweeping action. A handle 20 is mounted on the boom 12 for ease of handling the sweeper 10. A drive shaft 13 (see FIG. 2) extends from the power component 14 down through the boom 12 to connect with the brush component 16. The power component 14 thus is coupled to the brush component 16 and provides the motive power for rotating the brush component 16.

It is preferable to have the weight of the sweeper 10 to be in the range of about twenty to thirty pounds to facilitate ease of usage by an operator. The brush component 16 is constructed to limit the sweeper within this weight range. Additionally, the brush component 16 is arranged to provide a desired sweeping action within the power range of the power component 14 and does not require excessive force for an operator to maneuver.

The sweeper 10 may be utilized in two operating modes. In one mode the brush component 16 is rotated in the direction indicated by arrow 24 to produce a sweeping action toward an operator be gripping the handle 20 and boom 12. Alternatively, the sweeper 10 may be turned over such that the brush component 16 will be rotated in the direction indicated by arrow 26 to produce a sweeping action that will be away from the operator.

Figure 2:
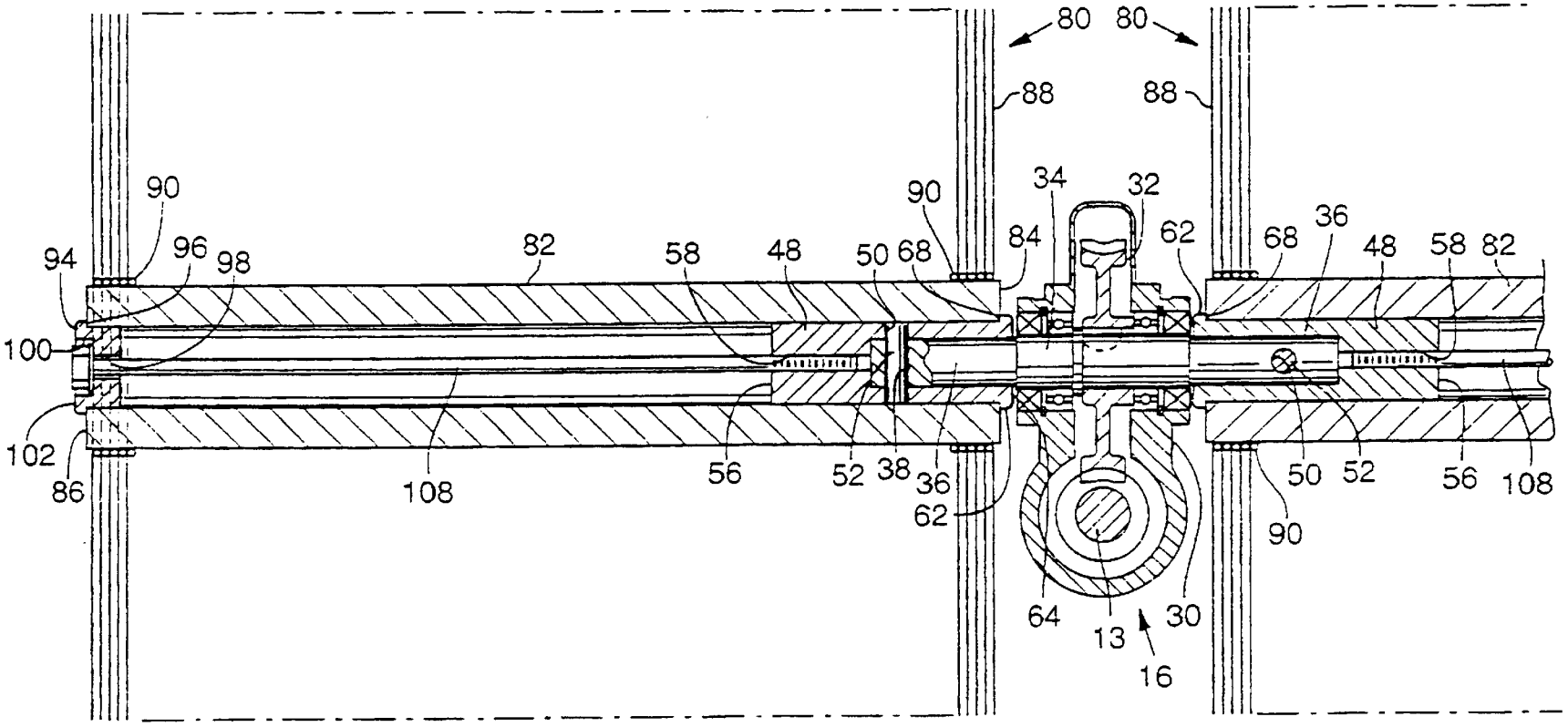
FIG. 2 is a sectional view illustrating brush assemblies mounted to a drive case.

FIG. 2 is a sectional view of the brush component 16 that is mounted on the end of the boom 12. The brush component 16 includes a drive case 30 that is mounted on the end of the boom 12. The drive case 30 is arranged to receive the end of the boom 12 and its corresponding drive shaft 13. The drive shaft 13 includes a worm gear which is coupled to a gear 32 to rotate the shaft 34. As shown, the shaft 34 has a stub shaft 36 extending from each end in a substantially horizontal arrangement. Each stub shaft 36 has a cross bore 38 for the removable mounting of an adapter or coupling member 48.

The adapter 48 has a cross bore 50 that is alignable with the cross bore 38 in the stub shaft 36. A spring pin (roll pin) 52 is insertable into the aligned bores 38, 50 to thus secure the adapter 48 to the stub shaft 36.

The adapter 48 has a center threaded bore 58 that extends from an end 56. The bore 58 of one adapter 48 is provided with right hand threads and the adapter 48 that is mountable on the other stub shaft 36 has its bore 58 provided with left hand threads. The adapter 48 is substantially cylindrical and has an enlarged diameter 62 on the end 64. The enlarged diameter 62 thus provides a shoulder portion on the periphery of the adapter 48 with the shoulder portion being designated as 68.

A brush assembly 80 is mountable on the adapter 48. The brush assembly 80 has a hollow core 82 that has an internal diameter that corresponds closely with the external diameter of the adapter 48. The core 82 is mounted on the adapter 48 with an end 84 of the core 82 of the brush assembly 80 being positioned against the shoulder 68 of the adapter 48. The shoulder 68 of the adapter 48 has a diameter that is in excess of the internal bore of the core 82.

A cylindrical bushing 94 which has a shoulder portion 96 is insertable into the opposite end of the core 82. The shoulder portion 96 of the bushing 94 will come in contact with the end 86 of the core 82. The bushing 94 has a center through bore 98 that will receive a bolt 108. The through bore 98 is counter bored with the counter bore being designated as 100. The counter bore 100 is of a sufficient diameter and depth to receive the head of the bolt 108 with the head end of the bolt 108 being substantially flush with the end 102 of the bushing 94. The diameter of the counter bore 100 is large enough to accommodate a tool such as a socket wrench to tighten and loosen the bolt 108.

The bushing 94 is installed in the end of the core 82. The bolt 108 is inserted into the through bore 98 of the bushing 94 and the threaded end of the bolt 108 is threadably installed in the threaded bore 58 of the adapter 48. The bolt 108 has a thread form (left or right hand) corresponding to the thread form in the bore 58 of the adapter 48. The bolt 108 is tightened to secure the core 82 and thus the brush assembly 80 to the stub shaft 36.

Tightening of the bolt 108 will force the end 84 of the core 82 against the shoulder 68 of the adapter 48 and similarly the shoulder 96 of the bushing 94 will be forced against the end 86 of the core 82. The core 82 of the brush assembly 80 will be driven by the frictional engagement of the core 82 with the adapter 48 and bushing 94.

The adapter 48 mounted on the stub shaft 36 is selected to have its thread form, i.e., either right hand or left hand, selected such that rotation of the stub shaft 36 will tend to tighten the bolt 108 installed in the adapter 48.

A brush assembly 80 is installed on each stub shaft 36 as previously described and as illustrated in FIGS. 1 and 2. As shown, the brush assembly 80 has bristles 88 mounted to and extending radially from the core 82. The selection of the core diameter 82, the type of bristles 88, and the density of the bristles 88 on the core 82 are of importance to the operation of the hand held sweeper 10. It is preferable that the bristles 88 be of the type that will not absorb liquid and will retain their resiliency throughout the usage of the hand held sweeper 10.

It is considered beneficial to have a brush assembly 80 that has a select combination of core diameter, core length, bristle length and bristle density to provide an efficient sweeping action. The diameter of the core provides structural integrity to the brush assembly and also is a factor in the density of the bristles. The bristle length affects the overall diameter of the brush assembly 80 and the bristle length in combination with the bristle density affects the sweeping action produced by the bristles.

The following is an example of selected components of a brush assembly 80 to not only produce a beneficial sweeping action but also control the weight of the hand held sweeper 10. It will be appreciated that the specific dimensions and components may be varied to suit the application.

In this embodiment the core 82 (on which the bristles 88 are attached) is an aluminum tube that has a diameter in the range of about one to two inches. The internal diameter is selected to provide the core 82 with sufficient strength and rigidity to withstand the forces applied, such as during a sweeping operation. The length of the core is in the range of eight to ten inches.

Figure 3A:
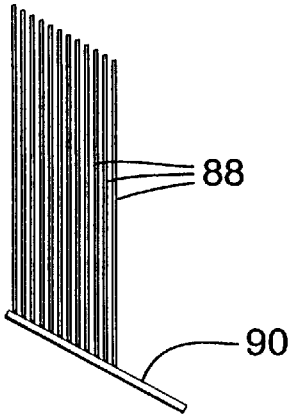
FIGS. 3A and 3B illustrate the manner of attaching bristles to a string.
Figure 3B:
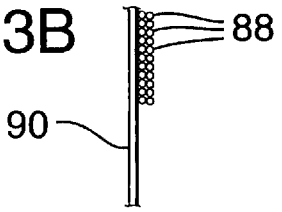

The ends of the bristles 88 are attached to a thin string 90 (rope) such as by gluing. It is preferable that the string 90 have a diameter in the range of about 0.05 to 0.07 inches. FIGS. 3A and 3B illustrate two examples of the fabrication of the bristles 88 and string 90. In FIG. 3A, one end of the bristles 88 are fixedly attached to the string 90 in a single row. The bristles 88 are shown in a spaced relation for drawing clarity however it is preferable that each bristle 88 be positioned closely to an adjacent bristle as shown in FIG. 3B to provide the desire bristle density. In FIG. 3B, two rows of bristles 88 are attached to the string 90 with the bristles 88 being positioned closely to adjacent bristles. It will be appreciated that in the double row configuration, a single row of bristles 88 may be attached to each side of the string 90. The bristles 88, whether they are applied in a single row or double row extend from the string 90 substantially parallel to each other.

Figure 4:
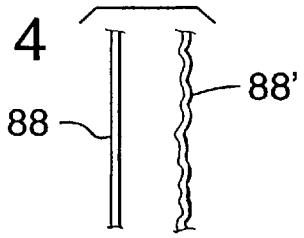
FIG. 4 illustrates examples of bristle types.

The bristles 88 are selected from a diameter range of about 0.020 to 0.040 inch. A bristle diameter of about 0.036 inch and a length of about four inches applied to a core 82 having a diameter in the range of about one to two inches provides the desired support and resistance to bending. The bristles 88 may be of the straight cylindrical type or of other variations such as the cylindrical crimped type 88' such as illustrated in FIG. 4.

The string 90 with the bristles 88 attached are helically or spirally wound on the external diameter of the core 82 with each winding being placed closely to a preceding winding as seen in FIG. 2, the helical winding denoted by the dash lines. The string 90 and the ends of the bristles 88 are fixedly attached to the core 82 as by gluing. The string 90 with the attached bristles 88 are attached to the core 82 in a manner to have the bristles 88 extending radially from the core 82. The placement of the bristles 88 adjacent each adjoining bristle attached to the string 90 and the close winding of the string 90 (and attached bristles 88) on the core 82 provides the desired density of the bristles 88 e.g., where the bristle ends occupy about one-third of the surface area of the core.

Figure 5:
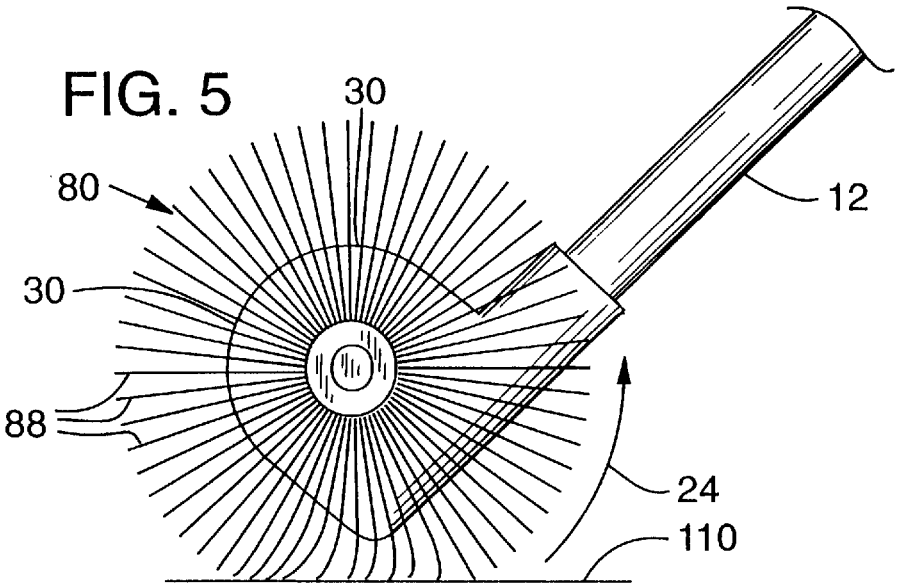
FIG. 5 illustrates the sweeping action of the hand held sweeper of FIG. 1.

The bristles 88 preferably have sufficient density and resiliency to support the end of the boom and the drive case 30 with little or no bending when in the static condition. That is, when the sweeper 10 is not in operation, the bristles 88 should remain substantially in an extended radial position relative to the core 82. When the core 82 and thus the brush assembly 80 is rotated by rotation of the stub shaft 36, the bristles 88 have a slight break over (bending) at their extended tips when in contact with a surface 110 as illustrated in FIG. 5. As shown, the brush assembly 80 is in contact with a surface 110 that is to be swept and is rotated in the direction indicated by arrow 24. The ends of the bristles 88 have a slight break over or bending at their tips. The bristles 88 in FIG. 5 are shown in a spaced relation and the break over is exaggerated for drawing clarity. The break over (bending) of the bristles 88 at their tips produces a flipping action to propel material on the surface 110. This action also permits penetration of the bristles 88 into cracks or crevasses for removal of material from the cracks or crevasses.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A ground supported power tool for sweeping support surfaces including sidewalks, driveways and the like comprising:

a cylindrical brush component defining a longitudinal axis that is horizontally disposed;

a handle component extended from the brush component as supported on a support surface so as to be gripped by an operator in a standing position;

a power source component;

said brush component mounted to one end of the handle component and the power source mounted to the handle component and having a power drive interconnected to the brush component and rotating the brush component about its horizontally disposed axis;

said brush component comprising a cylindrical core having an axis and a circumferential surface, and bristles secured to the core and arranged on said core to project radially an equal distance from the core and substantially perpendicular to the axis of the core to define an outer cylindrical surface of bristle ends, said bristles arranged in a pattern having side by side adjacency around the circumference and in closely spaced relation axially throughout the circumferential area of the core whereby as a result of the bristles being fanned automatically in the circumferential direction, the bristle ends are substantially evenly disbursed axially and circumferentially across the outer cylindrical surface;

said tool being wheelless and having a determined weight, and said bristles of said brush as structurally arranged on said core having a density sufficient for supporting said weight on the tip ends of the bristles, and in an operating mode the bristles bending sufficiently to provide a digging and flipping action.

2. A tool as defined in claim 1 wherein the structure of the bristles of said brush have a density at the surface of said core whereby the bristle ends occupy at least about one-third of the surface area of said core and the tool having a weight between about 15 and 30 pounds.

3. A tool as defined in claim 2 wherein the bristles have a length of about four inches and the diameter of the core is between about one inch to two inches.

4. A tool for sweeping comprising:

a cylindrical brush component defining a longitudinal axis that is horizontally disposed;

a handle component;

a power source component;

said brush component mounted to one end of the handle component and the power source mounted to the handle component and having a power drive interconnected to the brush component and rotating the brush component about its longitudinal or horizontally disposed axis;

said brush component comprising a core and bristles secured to and radially projected from the core;

said tool as defined, having a determined weight, and said bristles of said brush cooperatively structured relative to said weight whereby said weight is supported by the bristles in a non-operating mode and the bristles do not visibly bend under said weight, and in an operating mode the bristles bend to provide a digging and flipping action; and said bristles applied to the core in the form of a long string binding the bristle inner ends in a continuous side-by-side row, the string and the row of bristles wrapped in helical fashion with each wrap consisting of string and bristles immediately adjacent to a preceding wrap.

5. A tool as defined in claim 4 wherein the string is no greater in diameter than about 0.06 inches and the bristle diameter is in the range of about 0.030 to 0.040 inch whereby in a side-by-side arrangement, the surface area of the core covered by the bristles is at least one-third the surface area of the core.

6. A tool as defined in claim 5 wherein the bristles are non-absorbent of water.

7. A tool for sweeping comprising:

a cylindrical brush component defining a longitudinal axis that is horizontally disposed;

a handle component;

a power source component;

said brush component mounted to one end of the handle component and the power source mounted to the handle component and having a power drive interconnected to the brush component and rotating the brush component about its longitudinal or horizontally disposed axis;

said brush component comprising a core and bristles secured to and radially projected from the core and the mounting of the brush component to the handle component including;

a pair of stub shafts provided on the ends of the handle component and projected horizontally in opposed directions from the end of the handle shaft, said stub shafts rotatively driven by the power source;

each of said stub shafts provided with a shoulder and a threaded center opening, said core having a center opening with one end slidably fit over the stub shaft and against the shoulder, and an elongate bolt having a threaded end mated to fit the center opening of the shaft when extended through the opposite end of the core, and a head on bolt at the end opposite the threaded end, said head having a shoulder engaging the end of the core whereby tightening the bolt onto the stub shaft compresses the core and generates frictional gripping and securement of the brush to the stub shaft in a rotation resistant relation.

8. A tool as defined in claim 7 wherein the direction of tightening of the bolt in the threaded opening of the stub shaft is the same direction as the direction of powered rotation of the stub shaft whereby sweeping action induces tightening of the bolt.

* * * * *